US010762822B2

(12) United States Patent
Huang et al.

(10) Patent No.: US 10,762,822 B2
(45) Date of Patent: Sep. 1, 2020

(54) PIXEL ARRAY AND DISPLAY DEVICE

(71) Applicant: AU Optronics Corporation, Hsin-Chu (TW)

(72) Inventors: Chun-Yu Huang, Hsin-Chu (TW); Chung-Lung Li, Hsin-Chu (TW); Fu-Yuan Liou, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 168 days.

(21) Appl. No.: 15/378,476

(22) Filed: Dec. 14, 2016

(65) Prior Publication Data

US 2017/0323594 A1 Nov. 9, 2017

(30) Foreign Application Priority Data

May 9, 2016 (TW) ..... 105114308 A

(51) Int. Cl.
*G09G 3/20* (2006.01)

(52) U.S. Cl.
CPC ... *G09G 3/2003* (2013.01); *G09G 2300/0426* (2013.01); *G09G 2300/0452* (2013.01); *G09G 2300/08* (2013.01); *G09G 2310/0275* (2013.01); *G09G 2310/0297* (2013.01)

(58) Field of Classification Search
CPC ..... G09G 3/2003
See application file for complete search history.

(56) References Cited

U.S. PATENT DOCUMENTS 5,457,552 A * 10/1995 Ogurtsov ..... G02F 1/13624 345/93
6,552,706 B1 * 4/2003 Ikeda ..... G09G 3/3607 345/100

(Continued)

FOREIGN PATENT DOCUMENTS

TW I254810 5/2006
TW I254810 B 5/2006

(Continued)

OTHER PUBLICATIONS

Taiwan Intellectual Property Office, "Office Action", dated Dec. 8, 2016.

(Continued)

*Primary Examiner* — Patrick F Marinelli
(74) *Attorney, Agent, or Firm* — WPAT, PC

(57) ABSTRACT

A pixel array is implemented in a display device. The display device includes a plurality of data lines and a plurality of scan lines. The pixel array includes a first sub pixel row, a second sub pixel row, and a third sub pixel row. The first sub pixel row includes a first sub pixel, a second sub pixel, and a third sub pixel. The second sub pixel row includes a fourth sub pixel, a fifth sub pixel, and a sixth sub pixel. The third sub pixel row includes a seventh sub pixel, an eighth sub pixel, and a ninth sub pixel. The seventh sub pixel is electrically coupled to a first data line. The first sub pixel, the fourth sub pixel, and the fifth sub pixel are electrically coupled to a second data line. The second sub pixel, the third sub pixel, and the eighth sub pixel are electrically coupled to a third data line. The sixth sub pixel and the ninth sub pixel are electrically coupled to a fourth data line.

18 Claims, 2 Drawing Sheets

(56) References Cited

U.S. PATENT DOCUMENTS 6,563,481 B1 * 5/2003 Watanabe ..... G09G 3/3648 345/103
6,850,305 B2 * 2/2005 Hsieh ..... G09G 3/3648 349/144
7,173,676 B2 * 2/2007 Jeon ..... G02F 1/136286 349/48
7,187,353 B2 * 3/2007 Credelle ..... G09G 3/3607 345/88
7,656,004 B2 * 2/2010 Jeon ..... G02F 1/136286 257/500
7,907,131 B2 * 3/2011 Su ..... G09G 3/2074 345/204
8,022,919 B2 * 9/2011 Kwon ..... G09G 3/3677 345/100
8,299,992 B2 * 10/2012 Chen ..... G09G 3/3648 345/87
8,547,304 B2 * 10/2013 Ito ..... G09G 3/3688 345/76
8,581,888 B2 * 11/2013 Lai ..... G09G 3/3614 345/204
8,619,019 B2 * 12/2013 Lee ..... G09G 3/3659 345/103
8,723,772 B2 * 5/2014 Yang ..... G09G 3/3614 345/88
8,723,897 B2 5/2014 Cheng et al.
9,064,472 B2 * 6/2015 Kim ..... G09G 3/3659
9,984,636 B2 * 5/2018 Shin ..... G09G 3/3648
2003/0090581 A1 * 5/2003 Credelle ..... G09G 3/20 348/273
2006/0164350 A1 * 7/2006 Kim ..... G09G 3/3614 345/87
2007/0070262 A1 * 3/2007 Hung ..... G02F 1/136286 349/43
2008/0218465 A1 * 9/2008 Tsou ..... G09G 3/3659 345/92
2008/0238817 A1 * 10/2008 Mamba ..... G09G 3/3648 345/55
2010/0123652 A1 * 5/2010 Chen ..... G09G 3/3648 345/87
2010/0149142 A1 * 6/2010 Hsu ..... G09G 3/3614 345/205
2010/0156771 A1 * 6/2010 Lee ..... G02F 1/136286 345/87
2010/0156868 A1 * 6/2010 Hirayama ..... G09G 3/3655 345/208
2011/0241979 A1 * 10/2011 Baek ..... G09G 3/3614 345/88
2011/0285950 A1 * 11/2011 Su ..... G02F 1/136286 349/139
2012/0026136 A1 * 2/2012 Zhang ..... G09G 3/3614 345/204
2012/0262431 A1 * 10/2012 Cheng ..... G09G 3/3614 345/204
2012/0306833 A1 * 12/2012 Lin ..... G09G 3/3614 345/208
2012/0307174 A1 * 12/2012 Lee ..... G09G 3/2003 349/54
2013/0293821 A1 * 11/2013 Su ..... G02F 1/136286 349/143
2014/0152705 A1 * 6/2014 Kwon ..... G09G 3/3275 345/690
2014/0198136 A1 * 7/2014 Lee ..... G09G 3/3266 345/690
2014/0333563 A1 * 11/2014 Saitoh ..... G09G 3/3648 345/173
2015/0170614 A1 * 6/2015 Sasanuma ..... G09G 3/3655 345/213
2016/0267858 A1 * 9/2016 Chen ..... G09G 3/3648
2016/0267862 A1 * 9/2016 Yao ..... G09G 3/3611
2017/0323594 A1 * 11/2017 Huang ..... G09G 3/2003
2018/0047352 A1 * 2/2018 Zhao ..... G09G 3/3607
2018/0182320 A1 * 6/2018 Zhu ..... G09G 3/3607
2019/0206346 A1 * 7/2019 Xi ..... G09G 3/3655

FOREIGN PATENT DOCUMENTS

TW 200826031 A 6/2008
TW 201308277 2/2013

OTHER PUBLICATIONS

State Intellectual Property Office of the People's Republic of China , "Office Action", dated Apr. 28, 2018.
National Intellectual Property Administration(Chinese Patent Office), "Office Action", dated Oct. 18, 2018.

* cited by examiner

PIXEL ARRAY AND DISPLAY DEVICE

BACKGROUND

Technical Field

The present disclosure relates to a display technology, and more particularly to a pixel array and a display device.

Related Art

With the development of display technologies, various novel display devices have been developed, for example, half source driving (HSD) display panels, tri-gate display panels and other types of display panels. However, such display panels still have many disadvantages. For example, the area of a driving chip is excessively large or there is a serious line mura phenomenon.

SUMMARY

Accordingly, the present disclosure provides a pixel array and a display device, so as to resolve the problems in the prior art.

An embodiment of the present disclosure relates to a pixel array, which is implemented in a display device. The display device comprises a plurality of data lines and a plurality of scan lines. The pixel array comprises a first sub pixel row, a second sub pixel row, and a third sub pixel row. The first sub pixel row comprises a first sub pixel, a second sub pixel, and a third sub pixel. The second sub pixel row comprises a fourth sub pixel, a fifth sub pixel, and a sixth sub pixel. The third sub pixel row comprises a seventh sub pixel, an eight sub pixel, and a ninth sub pixel. The seventh sub pixel is electrically coupled to a first data line. The first sub pixel, the fourth sub pixel, and the fifth sub pixel are electrically coupled to a second data line. The second sub pixel, the third sub pixel, and the eighth sub pixel are electrically coupled to a third data line. The sixth sub pixel and the ninth sub pixel are electrically coupled to a fourth data line.

An embodiment of the present disclosure relates to a display device. The display device comprises a plurality of data lines, a plurality of scan lines, a gate driver, a source driver, and a pixel array. The gate driver is electrically coupled to a plurality of scan lines. The source driver comprises a plurality of multiplexers. The plurality of multiplexers is electrically coupled to a plurality of corresponding data lines. The pixel array comprises a first sub pixel row, a second sub pixel row, and a third sub pixel row. The first sub pixel row comprises a first sub pixel, a second sub pixel, and a third sub pixel. The second sub pixel row comprises a fourth sub pixel, a fifth sub pixel, and a sixth sub pixel. The third sub pixel row comprises a seventh sub pixel, an eight sub pixel, and a ninth sub pixel. The seventh sub pixel is used for receiving a first data signal. The first sub pixel, the fourth sub pixel, and the fifth sub pixel are used for receiving a second data signal. The second sub pixel, the third sub pixel, and the eighth sub pixel are used for receiving a third data signal. The sixth sub pixel and the ninth sub pixel are used for receiving a fourth data signal.

Based on the above, applying the foregoing embodiment can reduce the area of a driving chip in a display panel and alleviate the line mura phenomenon.

BRIEF DESCRIPTION OF THE DRAWINGS

To make the aforementioned and other objectives, features, advantages and embodiments of the present disclosure more comprehensible, the accompanying drawings are described as follows.

DETAILED DESCRIPTION

Figure 1:
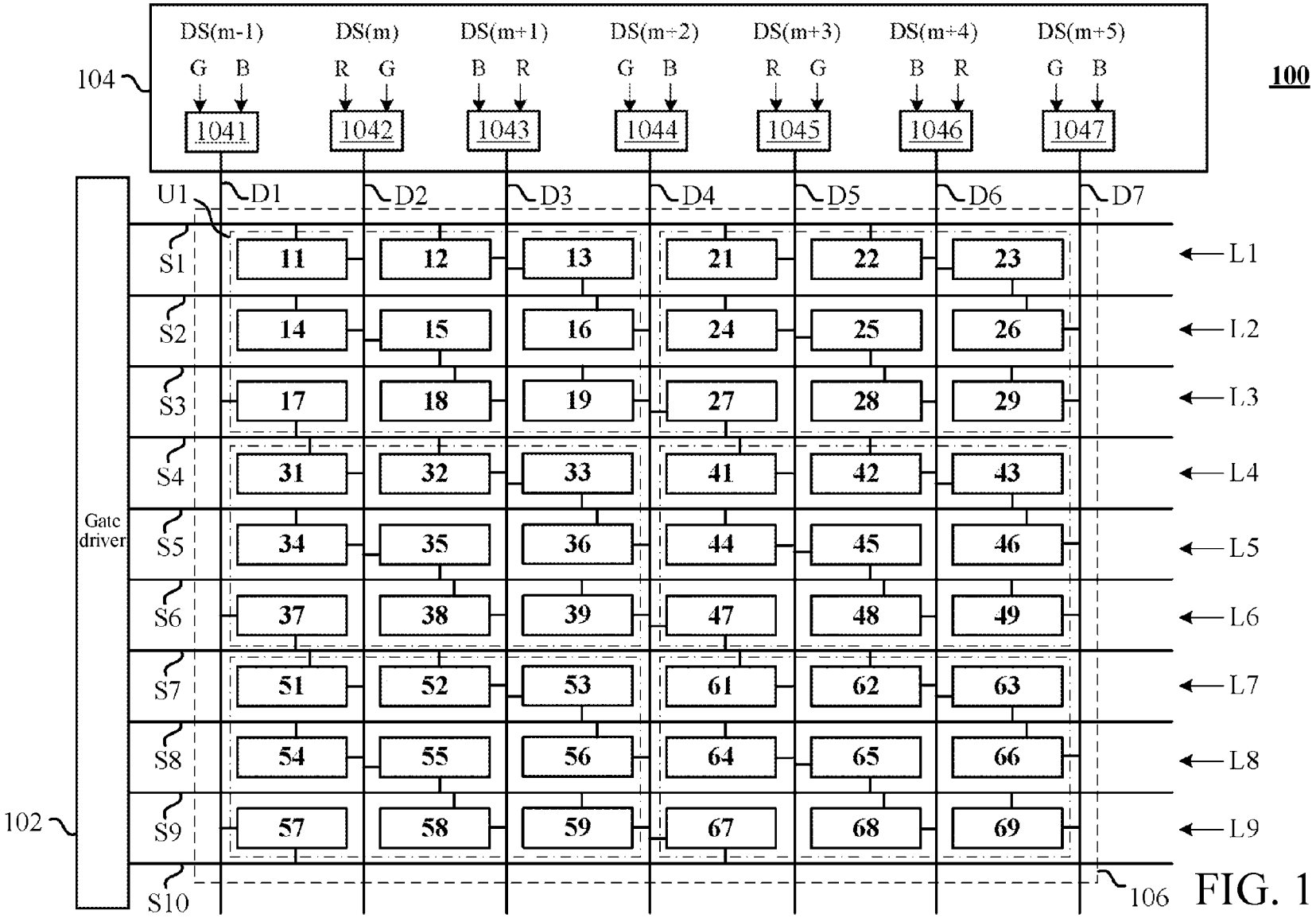
FIG. 1 is a schematic diagram of a display device according to some embodiments of the present disclosure.

Embodiments accompanied with figures are described in detail below. However, the embodiments provided are not intended to limit the scope of the present disclosure. The description of structures and operations are not intended to limit the order of execution. Any structure formed by recombining elements shall fall within the scope of the present disclosure as long as an equivalent apparatus can be generated. In addition, the figures are merely provided for the purpose of description, but are not drawn to scale. Like or similar elements are denoted by like reference numerals in the following description to facilitate understanding.

Unless otherwise specified, all the terms as used in this specification and the claims generally have the same meaning as is commonly understood by persons skilled in the art.

The terms "first", "second", "third" and the like as used herein are used for distinguishing between similar elements or operations and not necessarily for describing a sequence, either temporally, spatially, in ranking or in any other manner.

In addition, as used herein, "coupled" or "connected" may mean that two or more elements are either in direct physical or electrical contact, or that two or more elements are not in direct contact with each other but yet still co-operate or interact with each other.

FIG. 1 is a schematic diagram of a display device 100 according to some embodiments of the present disclosure. Referring to FIG. 1, the display device 100 comprises a gate driver 102, a source driver 104, a pixel array 106, a plurality of data lines D1 to D7, and a plurality of scan lines S1 to S10.

The gate driver 102 is electrically coupled to the scan lines S1 to S10 to output corresponding scan signals to the corresponding scan lines. The source driver 104 is electrically coupled to the data lines D1 to D7 to output corresponding data signals to the corresponding data lines. Sub pixels in the pixel array 106 generate corresponding gray levels according to the corresponding scan signals and the corresponding data signals.

In some embodiments, the source driver 104 comprises a plurality of multiplexers 1041 to 1047. The multiplexers 1041 to 1047 are electrically coupled to the data lines D1 to D7 respectively. In operation, the multiplexers 1041 to 1047 are used for receiving data signals DS(m−1) to DS(m+5) respectively and outputting the data signals to the data lines D1 to D7 respectively.

Referring to FIG. 1, the display device 100 is a tri-gate display panel. The pixel array 106 comprises a plurality of sub pixel rows L1-L9. Each sub pixel row comprises a plurality of sub pixels in a same color. For example, the first sub pixel row L1, the fourth sub pixel row L4, and the seventh sub pixel row L7 each include six first-color sub pixels (for example, red sub pixels). The second sub pixel row L2, the fifth sub pixel row L5, and the eighth sub pixel row L8 each include six second-color sub pixels (for example, green sub pixels). The third sub pixel row L3, the sixth sub pixel row L6, and the ninth sub pixel row L9 each include six third-color sub pixels (for example, blue sub pixels).

In other words, a plurality of unit areas jointly consists the pixel array 106. Taking a unit area U1 as an example, the unit area U1 has nine sub pixels 11 to 19. The first sub pixel 11, the second sub pixel 12, and the third sub pixel 13 are configured in the first sub pixel row L1. The fourth sub pixel 14, the fifth sub pixel 15, and the sixth sub pixel 16 are configured in the second sub pixel row L2. The seventh sub pixel 17, the eighth sub pixel 18, and the ninth sub pixel 19 are configured in the third sub pixel row L3.

The seventh sub pixel 17 is electrically coupled to the first data line D1. The first sub pixel 11, the fourth sub pixel 14, and the fifth sub pixel 15 are electrically coupled to the second data line D2. The second sub pixel 12, the third sub pixel 13, and the eighth sub pixel 18 are electrically coupled to the third data line D3. The sixth sub pixel 16 and the ninth sub pixel 19 are electrically coupled to the fourth data line D4.

The first sub pixel 11 and the second sub pixel 12 are electrically coupled to the first scan line S1. The third sub pixel 13, the fourth sub pixel 14, and the sixth sub pixel 16 are electrically coupled to the second scan line S2. The fifth sub pixel 15, the eighth sub pixel 18, and the ninth sub pixel 19 are electrically coupled to the third scan line S3. The seventh sub pixel 17 is electrically coupled to the fourth scan line S4.

In such a configuration, the first data line D1 is electrically coupled to a blue sub pixel (the sub pixel 17). If there is another sub pixel configured on the left of the first data line D1, the first data line D1 may even be electrically coupled to a green sub pixel. Therefore, the first data signal DS(m−1) comprises a green data signal and a blue data signal.

Similarly, because the second data line D2 is electrically coupled to a red sub pixel (the sub pixel 11) and green sub pixels (the sub pixel 14 and the sub pixel 15), the second data signal DS(m) comprises a red data signal and green data signals.

Similarly, because the third data line D3 is electrically coupled to red sub pixels (the sub pixel 12 and the sub pixel 13) and a blue sub pixel (the sub pixel 18), the third data signal DS(m+1) comprises red data signals and a blue data signal.

Similarly, because the fourth data line D4 is electrically coupled to a green sub pixel (the sub pixel 16) and a blue sub pixel (the sub pixel 19), the fourth data signal DS(m+2) comprises a green data signal and a blue data signal.

It should be particularly noted that other unit areas have a similar configuration, and therefore will not be detailed herein again.

Taking a display panel which resolution of video graphics array is (640×480) as an example, if a conventional pixel configuration is used, 1920 (640×3) scan lines and 480 data lines are needed. In other words, a total of 2400 lines are needed. However, if the configuration of the display panel 100 is used, only (640+1) scan lines and (480×3+1) data lines are needed. In other words, a total of 2082 lines are needed. That is to say, provided that same resolution is required, a tri-gate display panel has fewer lines, therefore the area needed can be reduced. In addition, the gate driver 102 can be implemented on the pixel array 106 by means of the Gate Driver on Array (GOA) technology, thereby reducing manufacturing costs.

In addition, for the conventional pixel configuration, because all the data lines need to charge a red sub pixel, a green sub pixel, and a blue sub pixel, all the data lines need to be electrically coupled to three gamma resistor strings (a gamma resistor string corresponding to red data signals, a gamma resistor string corresponding to green data signals, and a gamma resistor string corresponding to blue data signals). However, in the display panel 100, all the data lines need to be electrically coupled to only two gamma resistor strings. For example, the second data line D2 is electrically coupled to the gamma resistor string corresponding to red data signals and the gamma resistor string corresponding to green data signals through the multiplexers 1042. Therefore, compared with the conventional pixel configuration, the area of a driving chip of the display panel 100 and manufacturing costs of the display panel 100 can be reduced.

In addition, compared with an HSD display panel, the display panel 100 can effectively alleviate the line mura phenomenon. A detailed description is given below.

In some embodiments, the display panel 100 uses a forward scan. That is to say, in a same frame, the scan sequence of the display panel 100 is scanning sequentially downward from the first scan line S1, the second scan line S2, the third scan line S3, and the fourth scan line S4.

For example, the fourth sub pixel 14 and the fifth sub pixel 15 are both charged according to the second data signal DS(m). However, because the second scan line S2 is scanned earlier than the third scan line S3, the fourth sub pixel 14 is charged earlier and the fifth sub pixel 15 is charged later. In this case, a line mura phenomenon occurs between the fourth sub pixel 14 and the fifth sub pixel 15. Likewise, the line mura phenomenon also occurs between the sub pixel 34 and the sub pixel 35. The line mura phenomenon also occurs between the sub pixel 54 and the sub pixel 55.

In an HSD display panel, the line mura phenomenon occurs between all sub pixels on the two sides of the entire data line. However, in the display panel 100, the line mura phenomenon occurs only at three positions on each data line. That is to say, the configuration of the pixel array 106 not only can reduce the area of the driving chip of the display panel 100 and the manufacturing costs of the display panel 100, but also can alleviate the line mura phenomenon.

In some other embodiments, the display panel 100 uses a reverse scan. That is to say, in a same frame, the scan sequence of the display panel 100 is scanning sequentially upward from the tenth scan line S10, the ninth scan line S9, the eighth scan line S8, and the seventh scan line S7.

In some other embodiments, the display panel 100 uses a forward scan in one frame, and uses a reverse scan in a next frame. In other words, the scan sequence of the scan lines (taking the scan line S1 to S4 as an example) is sequentially the first scan line S1, the second scan line S2, the third scan line S3, and the fourth scan line S4 in a first frame, and is sequentially the fourth scan line S4, the third scan line S3, the second scan line S2, and the first scan line S1 in a second frame. However, the scan method of the display panel 100 is not limited in the present disclosure. Other scan methods shall also be encompassed by the present disclosure.

Figure 2:
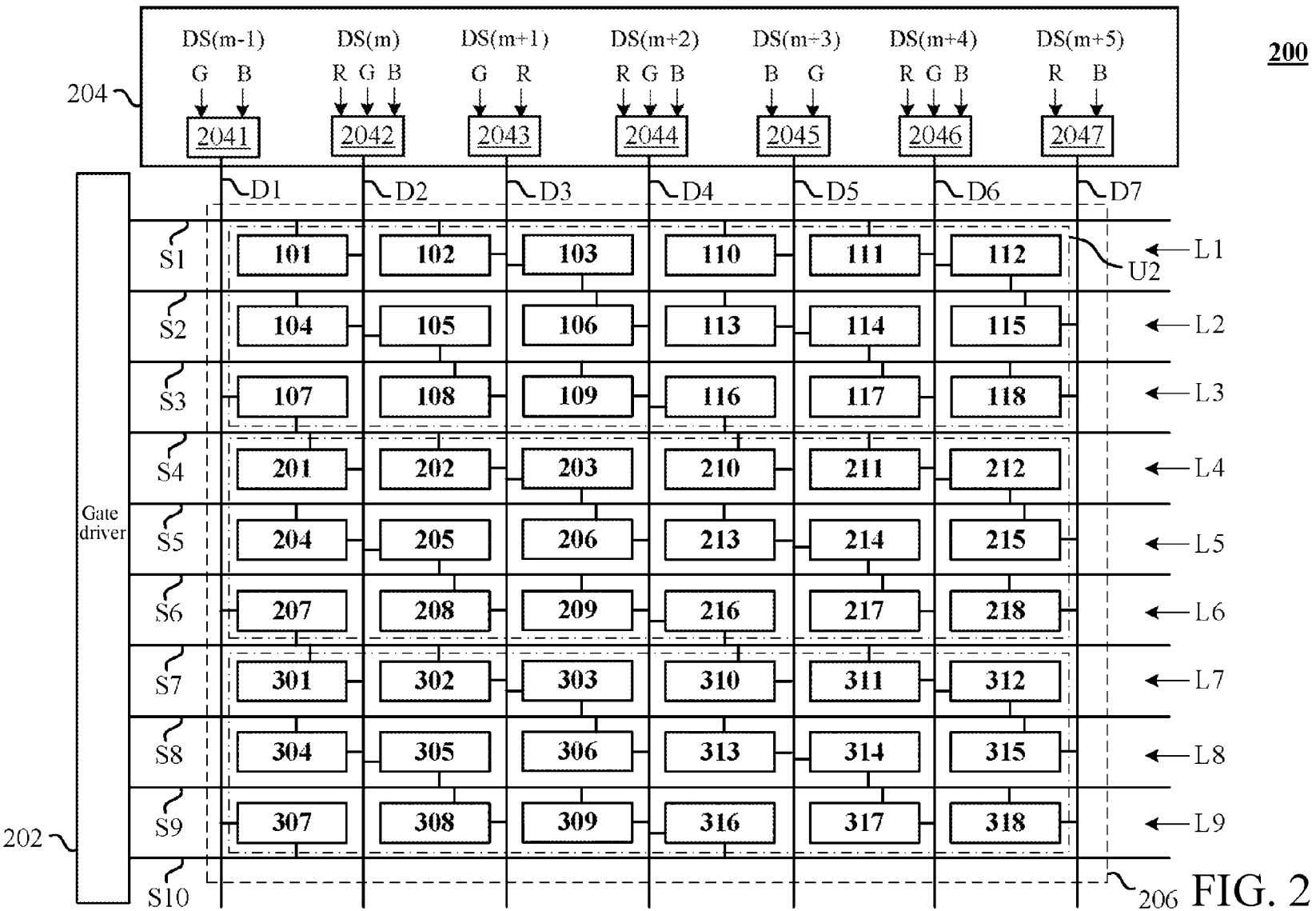
FIG. 2 is a schematic diagram of a display device according to some embodiments of the present disclosure.

FIG. 2 is a schematic diagram of a display device 200 according to some embodiments of the present disclosure. Referring to FIG. 2, the display device 200 comprises a gate driver 202, a source driver 204, a pixel array 206, a plurality of data lines D1 to D7, and a plurality of scan lines S1 to S10.

The gate driver 202 is electrically coupled to the scan lines S1 to S10 to output corresponding scan signals to the corresponding scan lines. The source driver 204 is electrically coupled to the data lines D1 to D7 to output corresponding data signals to the corresponding data lines. Sub pixels in the pixel array 206 generate corresponding gray levels according to the corresponding scan signals and the corresponding data signals.

In some embodiments, the source driver 204 comprises a plurality of multiplexers 2041 to 2047. The multiplexers 2041 to 2047 are electrically coupled to the data lines D1 to D7 respectively. In operation, the multiplexers 2041 to 2047 are used for receiving data signals DS(m−1) to DS(m+5) respectively and outputting the data signals to the data lines D1 to D7 respectively.

The configuration of the pixel array 206 is also duplicated. In other words, a plurality of unit areas jointly consists the pixel array 206. Taking a unit area U2 as an example, the unit area U2 has eighteen sub pixels 101 to 118.

The coupling relationship between the sub pixels 101 to 109 and the data lines and scan lines is similar to that between the sub pixels 11 to 19 and the data lines and scan lines in FIG. 1, and therefore will not be detailed herein again.

The coupling relationship between the sub pixels 110 to 118 and the data lines and scan lines is similar to that between the sub pixels 21 to 29 and the data lines and scan lines in FIG. 1. In particular, the sixteenth sub pixel 116 is electrically coupled to the fourth data line D4. The tenth sub pixel 110, the thirteenth sub pixel 113, and the fourteenth sub pixel 114 are electrically coupled to the fifth data line D5. The eleventh sub pixel 111, the twelfth sub pixel 112, and the seventeenth sub pixel 117 are electrically coupled to the sixth data line D6. The fifteenth sub pixel 115 and the eighteenth sub pixel 118 are electrically coupled to the seventh data line D7.

The tenth sub pixel 110 and the eleventh sub pixel 111 are electrically coupled to the first scan line S1. The twelfth sub pixel 112, the thirteenth sub pixel 113, and the fifteenth sub pixel 115 are electrically coupled to the second scan line S2. The fourteenth sub pixel 114, the seventeenth sub pixel 117, and the eighteenth sub pixel 118 are electrically coupled to the third scan line S3. The sixteenth sub pixel 116 is electrically coupled to the fourth scan line S4.

The difference between the pixel array 206 and the pixel array 106 lies in that the arrangement of pixels in the pixel array 206 is a delta arrangement. In other words, each sub pixel row of the pixel array 206 comprises sub pixels in two colors.

For example, in the first sub pixel row L1 of the pixel array 206, the first sub pixel 101, the third sub pixel 103, and the eleventh sub pixel 111 are first-color sub pixels (for example, red sub pixels), and the second sub pixel 102, the tenth sub pixel 110, and the twelfth sub pixel 112 are second-color sub pixels (for example, green sub pixels).

In the second sub pixel row L2 of the pixel array 206, the fourth sub pixel 104, the sixth sub pixel 106, and the fourteenth sub pixel 114 are second-color sub pixels (for example, green sub pixels), and the fifth sub pixel 105, the thirteenth sub pixel 113, and the fifteenth sub pixel 115 are third-color sub pixels (for example, blue sub pixels).

In the second sub pixel row L3 of the pixel array 206, the seventh sub pixel 107, the ninth sub pixel 109, and the seventeenth sub pixel 117 are third-color sub pixels (for example, blue sub pixels), and the eighth sub pixel 108, the sixteenth sub pixel 116, and the eighteenth sub pixel 118 are first-color sub pixels (for example, red sub pixels).

In such a configuration, the first data line D1 is electrically coupled to a blue sub pixel (the sub pixel 107). If there is another sub pixel configured on the left of the first data line D1, the first data line D1 may even be electrically coupled to a green sub pixel. Therefore, the first data signal DS(m−1) comprises a green data signal and a blue data signal.

Because the second data line D2 is electrically coupled to a red sub pixel (the sub pixel 101), a green sub pixel (the sub pixel 104), and a blue sub pixel (the sub pixel 105), the second data signal DS(m) comprises a red data signal, a green data signal, and a blue data signal.

Because the third data line D3 is electrically coupled to a red sub pixel (the sub pixel 102) and green sub pixels (the sub pixel 103 and the sub pixel 108), the third data signal DS(m+1) comprises a red data signal and green data signals.

Because the fourth data line D4 is electrically coupled to a red sub pixel (the sub pixel 116), a green sub pixel (the sub pixel 106), and a blue sub pixel (the sub pixel 109), the fourth data signal DS(m+2) comprises a red data signal, a green data signal, and a blue data signal.

Because the fifth data line D5 is electrically coupled to green sub pixels (the sub pixel 110 and the sub pixel 114) and a blue sub pixel (the sub pixel 113), the fifth data signal DS(m+3) comprises green data signals and a blue data signal.

Because the sixth data line D6 is electrically coupled to a red sub pixel (the sub pixel 111), a green sub pixel (the sub pixel 112), and a blue sub pixel (the sub pixel 117), the sixth data signal DS(m+4) comprises a red data signal, a green data signal, and a blue data signal.

Because the seventh data line D7 is electrically coupled to a sub pixel (the sub pixel 118) and a blue sub pixel (the sub pixel 115), the seventh data signal DS(m+5) comprises a red data signal and a blue data signal.

For the conventional pixel configuration, because all the data lines need to charge a red sub pixel, a green sub pixel, and a blue sub pixel, all the data lines need to be electrically coupled to three gamma resistor strings (a gamma resistor string corresponding to red data signals, a gamma resistor string corresponding to green data signals, and a gamma resistor string corresponding to blue data signals). However, in the display panel 200, the data lines D1, D3, D5 and D7 need to be electrically coupled to only two gamma resistor strings. Therefore, compared with the conventional pixel configuration, the area of a driving chip of the display panel 200 and manufacturing costs of the display panel 200 can be reduced.

In addition, because the line mura phenomenon occurs only at three positions on each data line of the display panel 200, the line mura phenomenon can also be alleviated.

It should be noted that the number of data lines, the number of scan lines, and the number of sub pixels in the foregoing display devices are provided for exemplary purpose only, and the present disclosure is not limited thereto.

Based on the above, applying the foregoing embodiment can reduce the area of a driving chip in a display panel and alleviate the line mura phenomenon.

The present disclosure is disclosed through the foregoing embodiments; however, these embodiments are not intended to limit the present disclosure. Various changes and modifications made by persons of ordinary skill in the art without departing from the spirit and scope of the present disclosure shall fall within the protection scope of the present disclosure. The protection scope of the present disclosure is subject to the appended claims.

What is claimed is:

1. A pixel array, implemented in a display device, wherein the display device comprises a plurality of data lines and a plurality of scan lines, the plurality of data lines includes a first data line for transmitting a first data signal, a second data line for transmitting a second data signal, a third data line for transmitting a third data signal, and a fourth data line for transmitting a fourth data signal, the pixel array comprising:

a first sub pixel row, comprising a first sub pixel, a second sub pixel, and a third sub pixel;

a second sub pixel row, comprising a fourth sub pixel, a fifth sub pixel, and a sixth sub pixel; and a third sub pixel row, comprising a seventh sub pixel, an eighth sub pixel, and a ninth sub pixel;

wherein the seventh sub pixel is electrically coupled to the first data line for receiving the first data signal, the first sub pixel, the fourth sub pixel, and the fifth sub pixel are electrically coupled to the second data line for receiving the second data signal, the second sub pixel, the third sub pixel, and the eighth sub pixel are electrically coupled to the third data line for receiving the third data signal, and the sixth sub pixel and the ninth sub pixel are electrically coupled to the fourth data line for receiving the fourth data signal;

wherein the plurality of scan lines includes a first scan line, a second scan line, a third scan line, and a fourth scan line; and wherein:

the first sub pixel and the second sub pixel are directly electrically coupled to the first scan line, the third sub pixel, the fourth sub pixel, and the sixth sub pixel are directly electrically coupled to the second scan line, the fifth sub pixel, the eighth sub pixel, and the ninth sub pixel are directly electrically coupled to the third scan line, and the seventh sub pixel is directly electrically coupled to the fourth scan line.

2. The pixel array according to claim 1, wherein the first sub pixel is a first color, and the fourth sub pixel and the fifth sub pixel are a second color.

3. The pixel array according to claim 2, wherein the second sub pixel and the third sub pixel are the first color, and the eighth sub pixel is a third color.

4. The pixel array according to claim 3, wherein the sixth sub pixel is the second color, and the seventh sub pixel and the ninth sub pixel are the third color.

5. The pixel array according to claim 1, wherein the first sub pixel, the second sub pixel, and the third sub pixel are a first color.

6. The pixel array according to claim 1, wherein a scan sequence of the plurality of scan lines is to sequentially drive the first scan line, the second scan line, the third scan line, and the fourth scan line in a first frame, and is to sequentially drive the fourth scan line, the third scan line, the second scan line, and the first scan line in a second frame.

7. The pixel array according to claim 1, wherein the plurality of data lines further comprises a fifth data line, a sixth data line, and a seventh data line;

wherein the first sub pixel row further comprises a tenth sub pixel, an eleventh sub pixel, and a twelfth sub pixel, the second sub pixel row further comprises a thirteenth sub pixel, a fourteenth sub pixel, and a fifteenth sub pixel, and the third sub pixel row further comprises a sixteenth sub pixel, a seventeenth sub pixel, and an eighteenth sub pixel; and wherein the sixteenth sub pixel is electrically coupled to the fourth data line, the tenth sub pixel, the thirteenth sub pixel, and the fourteenth sub pixel are electrically coupled to the fifth data line, the eleventh sub pixel, the twelfth sub pixel, and the seventeenth sub pixel are electrically coupled to the sixth data line, and the fifteenth sub pixel and the eighteenth sub pixel are electrically coupled to the seventh data line.

8. The pixel array according to claim 7, wherein the first sub pixel, the third sub pixel, the eighth sub pixel, the eleventh sub pixel, the sixteenth sub pixel, and the eighteenth sub pixel are first color.

9. The pixel array according to claim 8, wherein the second sub pixel, the fourth sub pixel, the sixth sub pixel, the tenth sub pixel, the twelfth sub pixel, and the fourteenth sub pixel are second-color sub pixels.

10. The pixel array according to claim 9, wherein the fifth sub pixel, the seventh sub pixel, the ninth sub pixel, the thirteenth sub pixel, the fifteenth sub pixel, and the seventeenth sub pixel are third-color sub pixels.

11. The pixel array according to claim 7, wherein the tenth sub pixel and the eleventh sub pixel are electrically coupled to the first scan line, the twelfth sub pixel, the thirteenth sub pixel, and the fifteenth sub pixel are electrically coupled to the second scan line, the fourteenth sub pixel, the seventeenth sub pixel, and the eighteenth sub pixel are electrically coupled to the third scan line, and the sixteenth sub pixel is electrically coupled to the fourth scan line.

12. A display device, comprising:

a plurality of data lines, comprising a first data line for transmitting a first data signal, a second data line for transmitting a second data signal, a third data line for transmitting a third data signal, and a fourth data line for transmitting a fourth data signal;

a plurality of scan lines;

a gate driver, electrically coupled to the plurality of scan lines;

a source driver, comprising a plurality of multiplexers, wherein the plurality of multiplexers is electrically coupled to the plurality of data lines; and a pixel array, comprising:

a first sub pixel row, comprising a first sub pixel, a second sub pixel, and a third sub pixel;

a second sub pixel row, comprising a fourth sub pixel, a fifth sub pixel, and a sixth sub pixel; and a third sub pixel row, comprising a seventh sub pixel, an eighth sub pixel, and a ninth sub pixel;

wherein the seventh sub pixel receives the first data signal, the first sub pixel, the fourth sub pixel, and the fifth sub pixel receive the second data signal, the second sub pixel, the third sub pixel, and the eighth sub pixel receive the third data signal, and the sixth sub pixel and the ninth sub pixel receive the fourth data signal;

wherein the plurality of scan lines includes a first scan line, a second scan line, a third scan line, and a fourth scan line; and wherein:

the first sub pixel and the second sub pixel are directly electrically coupled to the first scan line, the third sub pixel, the fourth sub pixel, and the sixth sub pixel are directly electrically coupled to the second scan line, the fifth sub pixel, the eighth sub pixel, and the ninth sub pixel are directly electrically coupled to the third scan line, and the seventh sub pixel is directly electrically coupled to the fourth scan line.

13. The display device according to claim 12, wherein the first sub pixel is a first color, and the fourth sub pixel and the fifth sub pixel are a second color.

14. The display device according to claim 13, wherein the second sub pixel and the third sub pixel are the first color, and the eighth sub pixel is a third color.

15. The display device according to claim 14, wherein the sixth sub pixel is the second color, and the seventh sub pixel and the ninth sub pixel are the third color.

16. The display device according to claim 12, wherein the first data signal corresponds to a second color and a third color, the second data signal corresponds to a first color and the second color, the third data signal corresponds to the third color and the first color, and the fourth data signal corresponds to the second color and the third color.

17. The display device according to claim 12, wherein the plurality of data lines further comprises a fifth data line for transmitting a fifth data signal, a sixth data line for transmitting a sixth data signal, and a seventh data line for transmitting a seventh data signal;

wherein the first sub pixel row further comprises a tenth sub pixel, an eleventh sub pixel, and a twelfth sub pixel, the second sub pixel row further comprises a thirteenth sub pixel, a fourteenth sub pixel, and a fifteenth sub pixel, and the third sub pixel row further comprises a sixteenth sub pixel, a seventeenth sub pixel, and an eighteenth sub pixel; and wherein the sixteenth sub pixel receives the fourth data signal, the tenth sub pixel, the thirteenth sub pixel, and the fourteenth sub pixel receive the fifth data signal, the eleventh sub pixel, the twelfth sub pixel, and the seventeenth sub pixel receive the sixth data signal, and the fifteenth sub pixel and the eighteenth sub pixel receive the seventh data signal.

18. The display device according to claim 17, wherein the first data signal corresponds to a second color and a third color, the second data signal corresponds to a first color, the second color, and the third color, the third data signal corresponds to the second color and the first color, the fourth data signal corresponds to the first color, the second color, and the third color, the fifth data signal corresponds to the third color and the second color, the sixth data signal corresponds to the first color, the second color, and the third color, and the seventh data signal corresponds to the first color and the third color.

* * * * *